US008444320B2

(12) United States Patent
Rusnak et al.

(10) Patent No.: US 8,444,320 B2
(45) Date of Patent: May 21, 2013

(54) TEAR RESISTANT BAG

(75) Inventors: John Rusnak, Aurora, IL (US); Calvin Ellis, Rogers, AR (US); Jeff Deel, White, GA (US); John Augustyn, Chicago, IL (US)

(73) Assignee: The Glad Products Company, Oakland, CA (US)

( * ) Notice: Subject to any disclaimer, the term of this patent is extended or adjusted under 35 U.S.C. 154(b) by 919 days.

(21) Appl. No.: 12/158,366

(22) PCT Filed: Dec. 11, 2006

(86) PCT No.: PCT/US2006/061868

§ 371 (c)(1),
(2), (4) Date: Jun. 20, 2008

(87) PCT Pub. No.: WO2007/079322

PCT Pub. Date: Jul. 12, 2007

(65) Prior Publication Data

US 2010/0278458 A1 Nov. 4, 2010

Related U.S. Application Data

(60) Provisional application No. 60/755,181, filed on Dec. 30, 2005.

(51) Int. Cl.
*B65D 33/16* (2006.01)

(52) U.S. Cl.
USPC ..... 383/77; 383/71; 383/903

(58) Field of Classification Search
USPC ..... 383/35, 77, 71, 903, 8, 10, 9, 120, 383/37
See application file for complete search history.

(56) References Cited

U.S. PATENT DOCUMENTS

| | | | | | |
|---|---|---|---|---|---|
| 3,052,399 | A | * | 9/1962 | Brown | 383/204 |
| 3,142,437 | A | * | 7/1964 | Grant et al. | 229/67.1 |
| 4,759,639 | A | * | 7/1988 | DeMatteis | 383/7 |
| 4,790,437 | A | * | 12/1988 | Pistner | 206/554 |
| 4,848,930 | A | * | 7/1989 | Williams et al. | 383/104 |
| 4,890,736 | A | | 1/1990 | Johannes | |
| 5,041,317 | A | | 8/1991 | Greyvenstein | |
| 5,246,110 | A | | 9/1993 | Greyvenstein | |
| 5,611,627 | A | | 3/1997 | Belias et al. | |
| 5,683,340 | A | | 11/1997 | Belias et al. | |
| 5,938,033 | A | * | 8/1999 | Huang et al. | 206/554 |
| 5,967,663 | A | * | 10/1999 | Vaquero et al. | 383/35 |

(Continued)

FOREIGN PATENT DOCUMENTS

| | | | |
|---|---|---|---|
| EP | 541028 | A1 * | 5/1993 |
| JP | 2002037401 | A * | 2/2002 |
| WO | WO 2006056784 | A1 * | 6/2006 |

*Primary Examiner* — Jes F Pascua
(74) *Attorney, Agent, or Firm* — Thomas Feix

(57) ABSTRACT

A tie bag for storing refuse or garbage includes an undulating top edge defining an opening to the bag. The top edge may include two flaps and two valleys. In one embodiment, the valley may include a flat portion at the bottom of the valley. The flaps may be tied together to at least partially close the bag. The bag further may include a first seam that intersects the flat portion of the valley. The flat portion reduces the possibility of tearing the seam. In another embodiment, the valley may include a slit. In an additional embodiment, the valley may include two secondary valleys and a center valley. In another embodiment, the seam may intersect the top edge at a point other than the lowest point in the valley.

7 Claims, 20 Drawing Sheets

U.S. PATENT DOCUMENTS 6,183,132 B1 * 2/2001 Simhaee ..... 383/37
6,435,350 B1 * 8/2002 Huang et al. ..... 206/554
6,565,794 B1 5/2003 Fraser
2002/0020648 A1 * 2/2002 Lam et al. ..... 206/390

* cited by examiner

TEAR RESISTANT BAG

FIELD OF THE INVENTION

The present invention relates generally to bags, and more particularly relates to tie bags.

BACKGROUND OF THE INVENTION

The use of tie bags for storage and disposal of garbage or refuse is well known in the art. The tie features of such bags are normally projecting flaps that are integral with the body of the bag. The flaps are tied together in order to close the bag. Such tie features represented an improvement over prior bags in that they provided an improved means for closing bags that did not greatly reduce the bag capacity. They were also generally easy to manufacture. Representative bags are disclosed in U.S. Pat. Nos. 4,890,736, 5,246,110, 5,611,627, and 6,565,794.

One problem inherent in such bags is that the seams that mark where portions of the bag are joined are susceptible to separating. Often the seams will meet the top edge of tie bags in the valleys proximate the flaps. Accordingly, when the bags are shaken by a person holding the bags by the flaps or are fitted over the rim of a garbage can, the forces applied by a user are concentrated at the point where the seam meets the valley and may cause the seams to open. The utility of the bag is thereby greatly reduced.

BRIEF SUMMARY OF THE INVENTION

The invention provides novel means for fortifying tie bags against separation at the seams. According to one aspect of the invention, there is provided a tie bag for storing refuse or garbage comprising an undulating top edge defining an opening to the bag, the top edge may include at least two rounded flaps with two convex sides and at least two valleys. Each valley may have two concave sides and a flat portion which defines the bottom of the valley. The top edge of the bag may be composed of alternating flaps and valleys such that each side of a valley is disposed between the flat portion of a valley and the side of a flap, and each side of a flap is disposed between a peak of a flap and a side of a valley. The flaps may be tied together to at least partially close the bag. The bag may further comprise a first seam that intersects the flat portion of a valley. The bag may also include a second seam that interests a second valley, opposite the first seam, at the flat portion of the second valley.

According to another aspect of the invention, there is provided a tie bag comprising a bag body and a top edge defining an opening. The top edge may include at least two flaps and at least two valleys, wherein the flaps may be to tied together to at least partially close the bag. The top edge may transition between the flaps and valleys along curves. The bag may also include at least one seam in the bag body that intersects the top edge at the lowest point of a first valley. The first valley may include a slit in the top edge that extends into the bag body.

According to yet another aspect of the invention, there is provided a tie bag comprising a bag body and a top edge defining an opening. The top edge may include at least two flaps defining primary peaks and at least two primary valleys, wherein each primary valley includes two secondary valleys and a center valley disposed between two secondary peaks. The primary valleys may be larger than the secondary valleys and the primary peaks may be larger than center peaks. The peaks and valleys may include two curved sides that join it to the peak or valley proximate it along the top edge. The flaps may be to tied together to at least partially close the bag. The bag may also include at least one seam in the bag body that intersects the top edge at the center peak of the first valley.

DETAILED DESCRIPTION OF THE INVENTION

Figure 1:
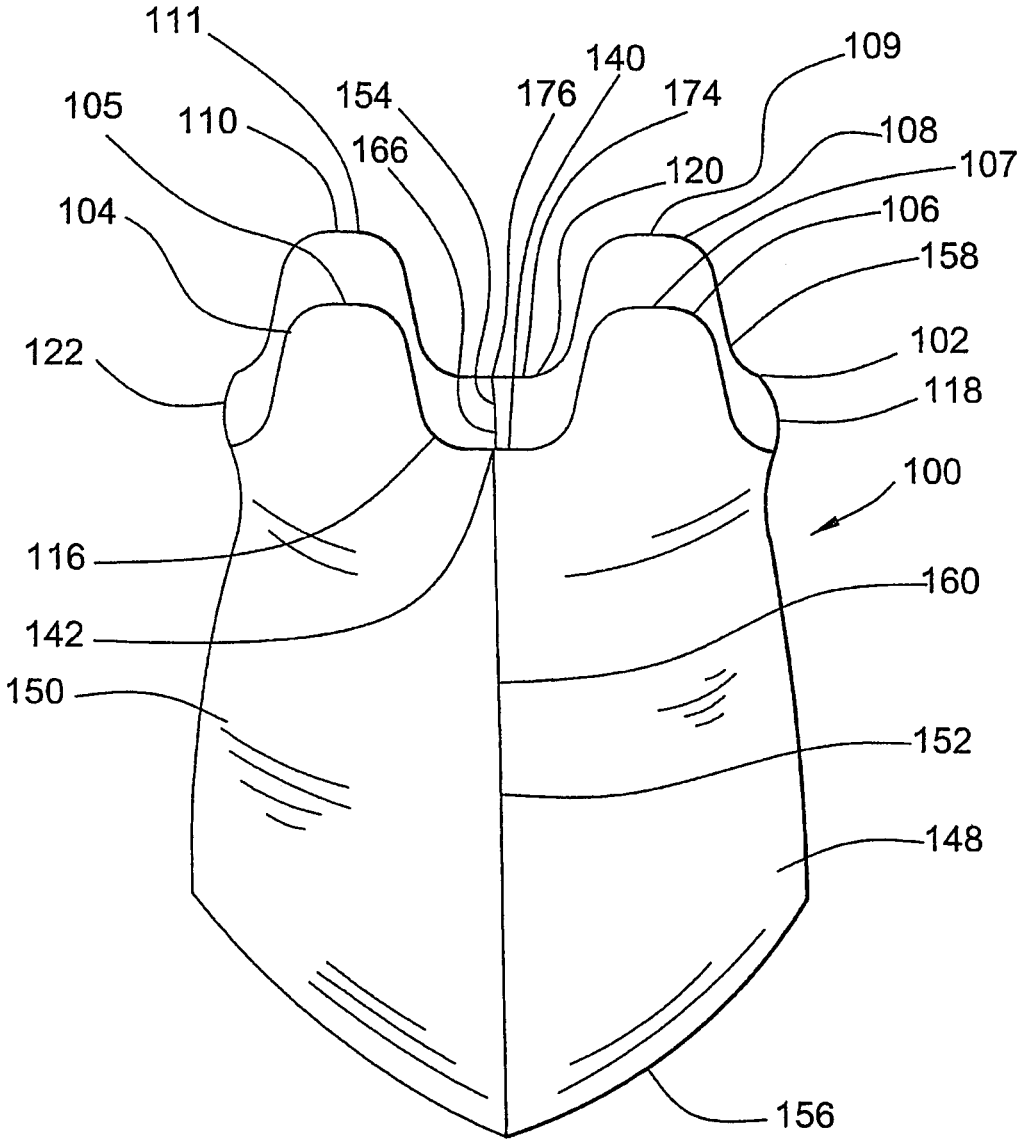
FIG. 1 is a perspective view of a tie bag with four flaps and four valleys with flat portions at the bottom.
Figure 3:
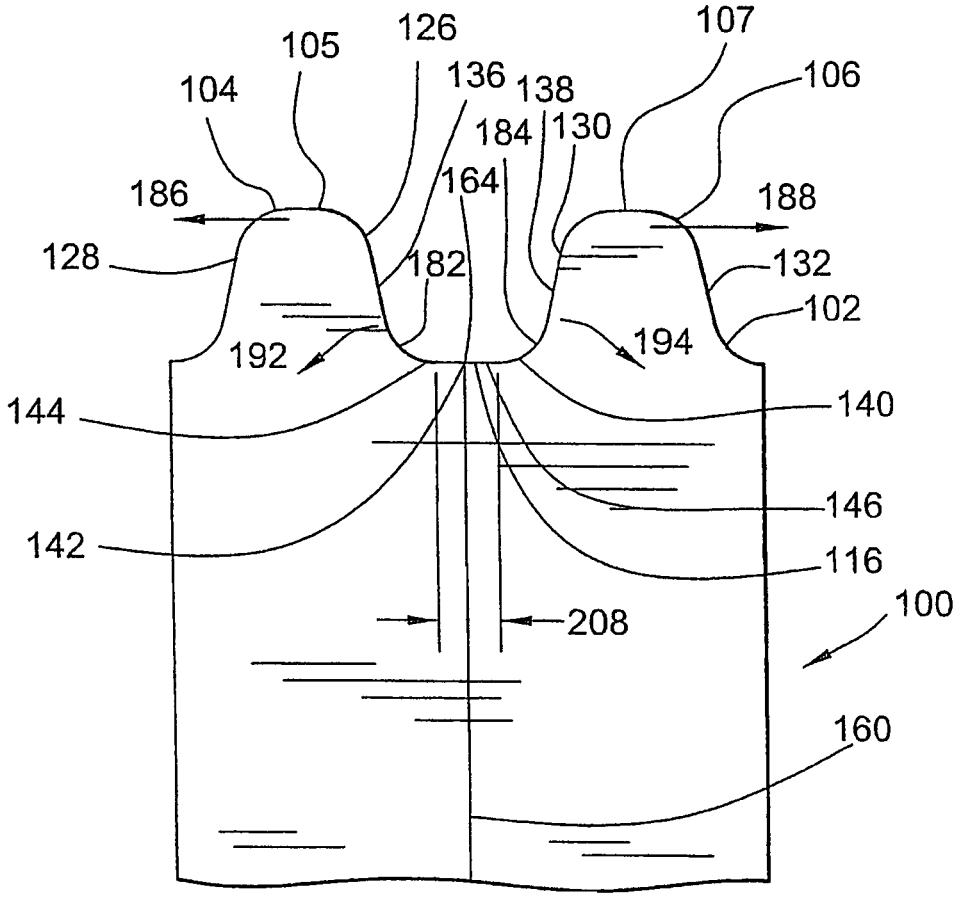
FIG. 3 is a side profile of the bag of FIG. 1 showing two flaps and a valley.

Referring to FIG. 1, there is provided a tie bag 100 for storing refuse or garbage which may include an undulating top edge 102 defining an opening to the bag. The top edge may include four flaps 104, 106 108, 110 and four valleys 116, 118, 120, 122. In this embodiment, the flaps 104, 106, 108, 110 of the tie bag 100 may have peaks 105, 107, 109, 111 which may be flat. The flaps and valleys may be similar in shape. Thus, flap 104 and valley 116 will be described below and the other flaps and valleys may be similarly shaped. Referring to FIG. 3, the flap 104 may include a first side 126 and a second side 128 wherein the sides 126, 128 of the flap 104 are convex. The valley 116 may include first and second concave sides 136, 138 and a flat portion 140 which defines the bottom of the valley 116. The top edge 102 of the bag 100 may include alternating flaps 104 and valleys 116. Accordingly, the side 126 of the flap 104 is disposed between the peak 105 of the flap 104 and the side 136 of the valley 116. The side 136 of the valley is disposed between the side 126 of the flap 104 and the flat portion 140 of the valley 116. The side 138 of the valley is disposed between the flat portion 140 and the side 130 of the flap 106. The side 130 of the flap 106 is disposed between the side 138 of the valley 116 and the peak 107 of the flap 106. All of the flaps and valleys may be configured in a similar alternating arrangement. In this embodiment, the tie bag 100 is made of a thermoplastic material such as, for example, high density or low density polyethylene or polypropylene.

Figure 2:
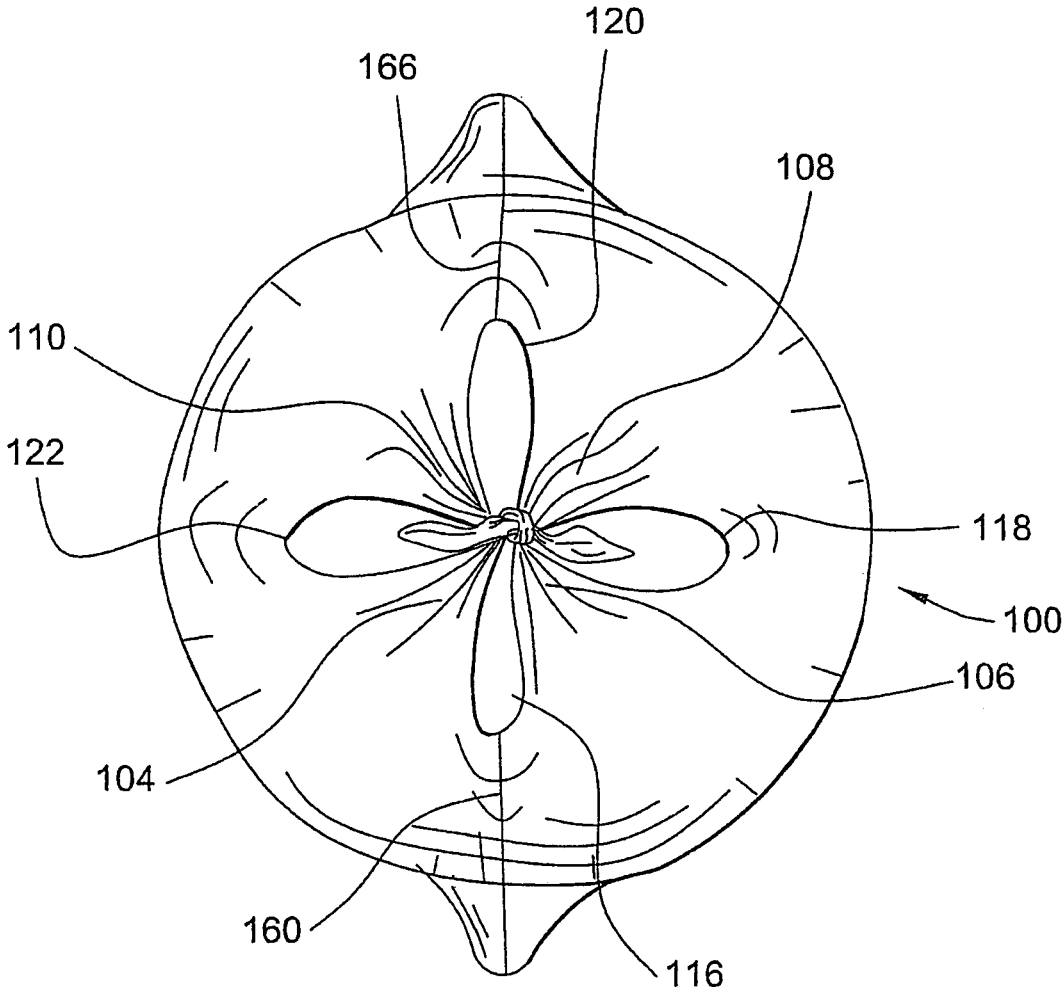
FIG. 2 is top view of the bag of FIG. 1, wherein the flaps have been tied together to close the bag.

Referring to FIG. 2, the flaps 104, 106, 108, 110 of the tie bag 100 may be tied together to at least partially close the bag 100. The flaps 104, 106, 108, 110 may be tied together in pairs, wherein each flap 104, 106 is tied to the flap 108, 110 opposite it along the top edge 102. Accordingly, the first flap 104 is tied to the third flap 108 while the second flap 106 is tied to the fourth flap 110. Once the flaps 104, 106, 108, 110 are tied together, the bag 100 is secured partially shut for storage or transport. The tied-together flaps 104, 106, 108, 110 also provide a means for easily gripping and lifting the bag 100. It will also be appreciated that although this embodiment has four flaps 104, 106, 108, 110 and four valleys 116, 118, 120, 122, the bag 100 may include any number flaps and valleys, as long as the bag includes at least two flaps that may be tied together. For example, the bag may have two, three, five, six, seven, eight, nine, or ten flaps.

Referring to FIG. 1, the tie bag 100 may include a front panel 148 and a back panel 150 joined along three edges 152, 154, 156. The top edge 102 defines the fourth edge 158, wherein the front panel 148 and the back panel 150 are not joined. The front panel 148 and the back panel 150 may be joined along the first edge 152 by a first seam 160 that runs from the third, or bottom, edge 156 to the top edge 102. Referring to FIG. 3, the first seam 160 intersects the flat portion 140 of the first valley 116 at a point 142 on that flat portion 140. In this embodiment, the first seam 160 may intersect the flat portion 140 at a middle point of the flat portion 140. In other embodiments, the seam may intersect at other locations. The seam 160 divides the flat portion 140 of the valley 116 into a first portion 144 and a second portion 146. The bag 100 may also include a second seam 166 that intersects the third valley 120 opposite the first seam 160 at a point 176 of the flat portion 174 of the third valley 120, as shown in FIG. 1. In this embodiment, the second seam 166 may intersect the flat portion 174 at a middle point of the flat portion 174. In other embodiments, the seam may intersect at other locations. The second seam 166 defines the second edge 154 and runs from the bottom edge 156 to where it intersects the top edge 102. The third edge 156 of the bag 100 may be a folded edge such as, for example, a U-fold. In another embodiment, the third edge may be defined by a third seam running between the bottoms of the first and second seams 160, 166. The seams 160, 166, may be formed by heat sealing, ultrasonic welding, adhesives, or folds.

Figure 4:
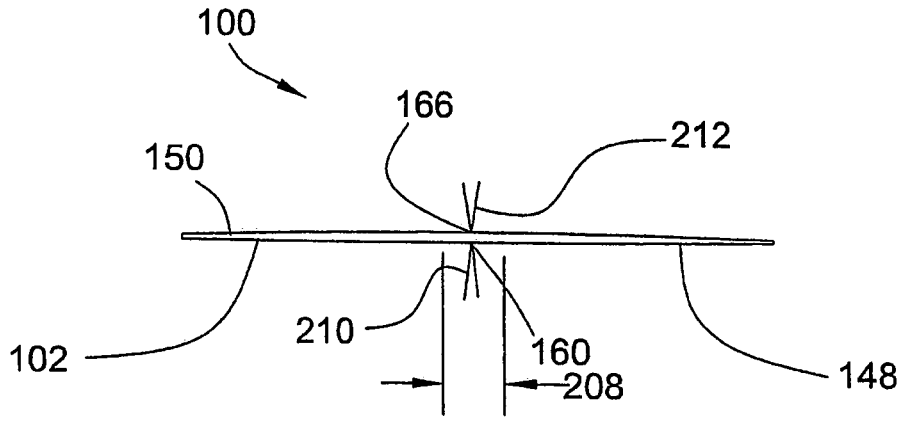
FIG. 4 is a top view of a bag.

Referring to FIG. 4, the seams 160, 166 of the bag 100 may include front panel and back panel material that forms first and second skirts 210, 212 along the length of the first and second seams 160, 166, respectively. The skirts can result from manufacturing processes in which the front panel 148 and back panel 150 are not joined at their outermost edges to form the seams 160, 166. The bag material of the panels 148, 150 beyond the first seam 160 and second seam 160 form the first skirt 210 and second skirt 212, respectively. As shown in FIG. 4, the length 208 of the flat portion 140 does not include the skirt 210. In other embodiments, the bag 100 may not include skirts.

Referring to FIG. 3, there is illustrated a profile of the first and second flaps 104, 106 and the first valley 116 disposed therebetween. The sides 136, 138 of the first valley meet the sides 126, 130 of first and second flaps 104, 106. In this embodiment, the valley sides 136, 138 meet the flap sides 126, 130 at approximately halfway between the vertical displacement between the peaks 105, 107 of the flaps 104, 106 and the flat portion 140 of the valley 116. In other embodiments, the valley sides 136, 138 may extend nearly to the peaks 105, 107 or the flap sides 126, 130 may extend nearly to the flat portion 140. The meeting points are generally where the concave sides 136, 138 of the valley 116 transition to the convex sides 126, 130 of the flaps 104, 106. As shown in FIG. 3, a rounded first corner 182 may be located where the first portion 144 of the flat portion 140 meets the first side 136 of the valley 116. Additionally, a rounded second corner 184 may be located where the second portion 146 of the flat portion 140 of the valley 116 meets the second side 138 of the valley 116. In other embodiments, the corners may not be rounded.

Figure 5:
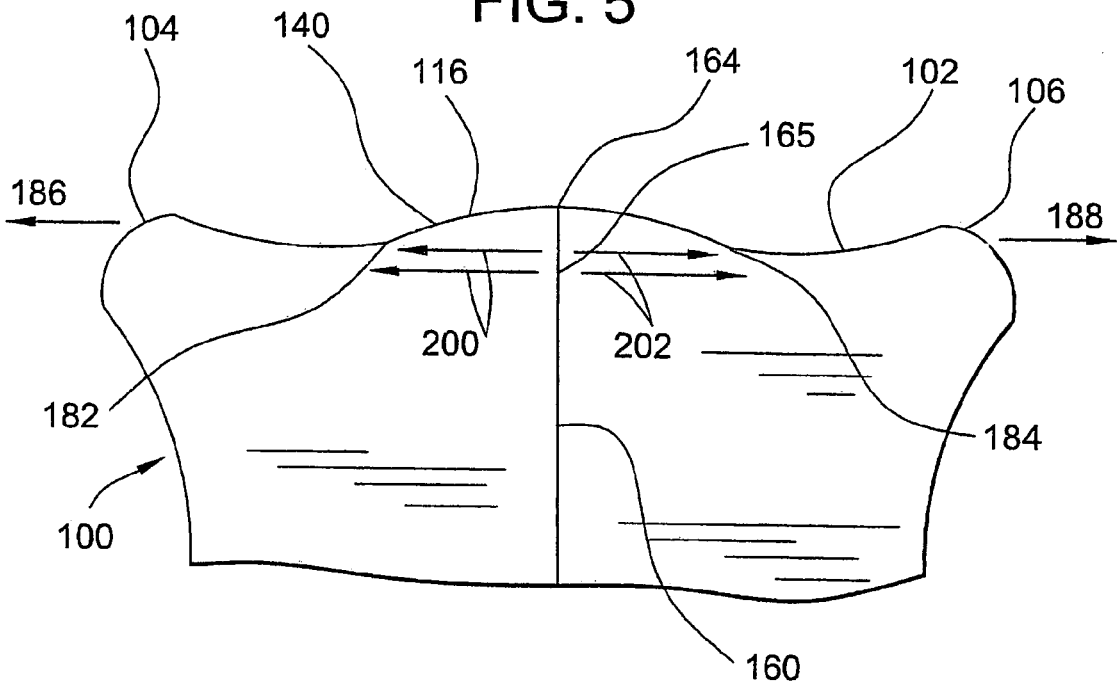
FIG. 5 is the same view as FIG. 3, but the flaps are subject to opposing forces.

Referring to FIGS. 3 and 5, during normal use of the tie bag 100, the bag 100 is often held and maneuvered by a user gripping the bag 100 by two or more flaps 104, 106, 108, 110. The user often subjects the bag 100 to a shaking up and down motion when opening the bag 100 before use or when attempting to orient the garbage or refuse inside the bag 100. When trying to fit the bag 100 around the rim of a garbage receptacle, the user can also expose the bag to stresses. The seams 160, 166 represent relatively weaker points in the structure of the bag 100. The bag 100 is therefore susceptible to separation at the seams 160, 166 if sufficient force is applied normal the seams 160, 166, consistent with the flaps 104, 106 being pulled apart. The intersection point 164 where the seam 160 meets the top edge 102 is particularly susceptible to tearing. FIG. 3 illustrates the vector components 186, 188 of the forces applied to the bag 100 by a user gripping the bag 100 at the first and second flaps 104, 106, which are normal to the seam 160. It will be appreciated that the size of the vector components 186, 188 that are normal to the seam will vary depending upon how forces are applied to the flaps.

Referring to FIGS. 3 and 5, as two adjacent flaps 104, 106 are pulled apart, the flaps 104, 106 tend to pivot out around the lowest point in the valley 116, thereby subjecting that point to significant stress. Because the tie bag 100 includes a flat portion 140 of the valley 116, this force 186, 188 is spread out over the length of the flat portion 140 and reduces the possibilities that any single point may experience the concentration of the forces 186, 188. As the flaps 104, 106 are pulled apart, the flaps 104, 106 tend to pivot about the corners 182, 184 of the valley 116, as shown by moment arrows 192, 194, such that the flat portion 140 tends to buckle and rise slightly therebetween, as shown in FIG. 5. Accordingly, the greatest tension experienced at the seam 160 is not at the weaker intersection point 164 along the top edge 102. Instead, forces 186, 188, which are perpendicular to the seam 160, are spread out over the top section of the seam 160 between points 164 and 165, as shown by force arrows 200 and 202.

Referring to FIG. 3, the length 208 of the flat portion 140 of the valley 116 in a first embodiment may be between 0.25 and 30 inches (0.625 and 75 cm). In a second embodiment, the length 208 may be between 0.5 and 15 inches (1.25 and 37.5 cm). In a third embodiment, the length 208 may be between 3 and 4 inches (7.5 and 10 cm). In a fourth embodiment, the length 208 may be between 2 and 3 inches (5 and 7.5 cm). In a fifth embodiment, the length 208 may be 2.5 inches (6.25 cm) for a bag which is 23.75 inches (59.375 cm) wide. However, it will be appreciated that the flat portion 140 of the valley 116 may be a variety of lengths depending on the overall size of the bag and the configuration of the flaps and valleys. It will also be appreciated that the flat portion 140 of the valley 116 may be only substantially flat. That is, the flat portion 140 may be defined by a slight curve or slope.

Figure 19:
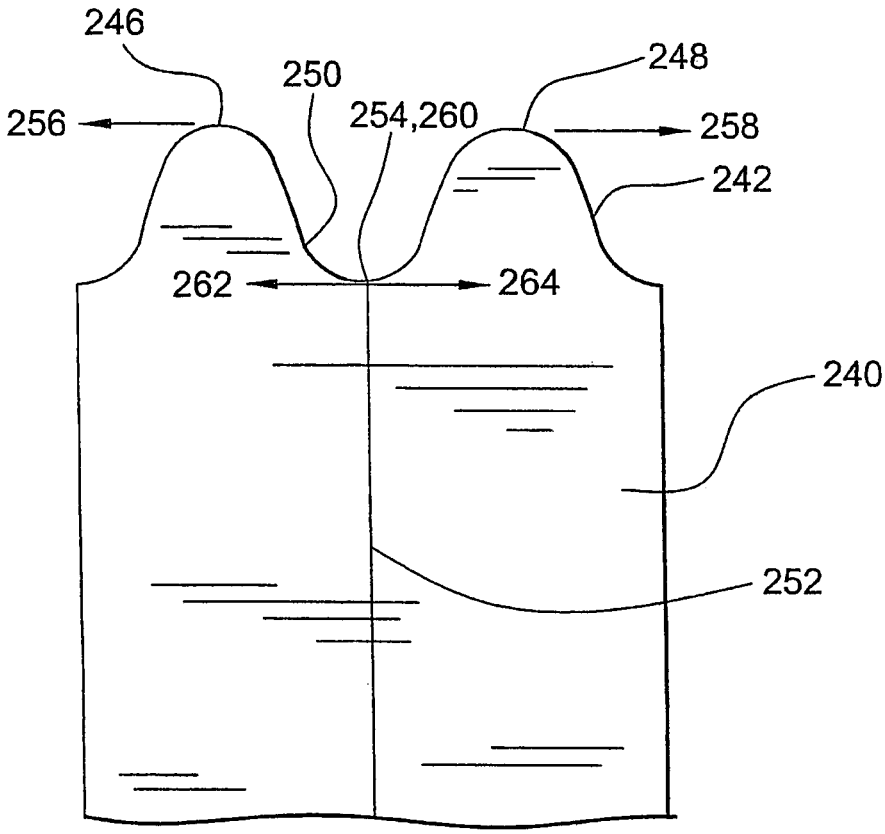
FIG. 19 (PRIOR ART)
FIG. 19 is a side profile of a bag of the prior art showing two flaps and a valley.
Figure 20:
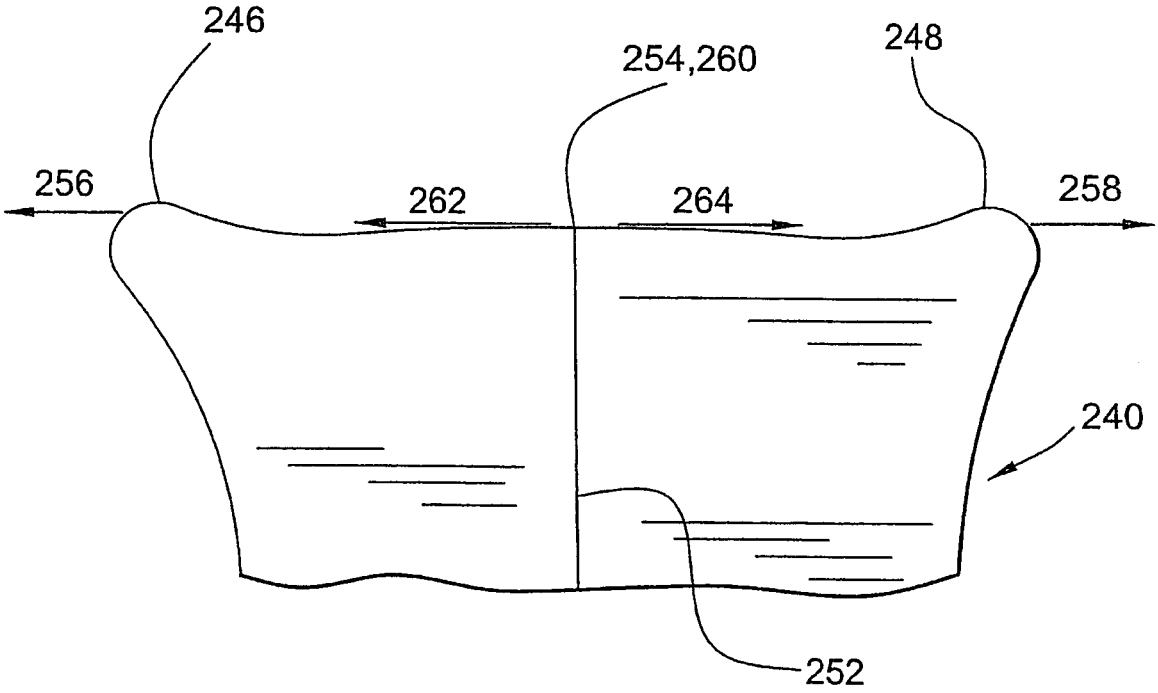
FIG. 20 (PRIOR ART)
FIG. 20 is the same view as FIG. 19, but the flaps are subject of opposing forces.

FIGS. 19 and 20 illustrate a tie bag 240 of the prior art including a top edge 242 with a wave configuration. The point 254 where the seam 252 meets the valley 250 is the lowest point 260 between the two flaps 246, 248. When the two flaps 246, 248 are being pulled apart, as shown by forces 256 and 258, the flaps 246, 248 tend to pivot out around that point 260. The intersection point 254 of the seam 252 may thereby be subject to concentrated stress, as shown by forces 262 and 264 in FIG. 20. The concentration of stress may lead to separation of the seam 252 at point 254. Compared to the prior art shown in FIGS. 19 and 20, the embodiment in FIGS. 1-5 can withstand greater forces applied to consecutive flaps 104, 106 before a tear at the seam 160 is initiated. Referring to FIG. 5, this increased strength occurs because the forces 200, 202 which are acting on the seam 160 are directed down from the intersection point 164. The forces 200, 202 are spread out over the area between point 164 and a lower point 165 on the seam 160 where the seam 160 is less likely to separate.

Figure 6:
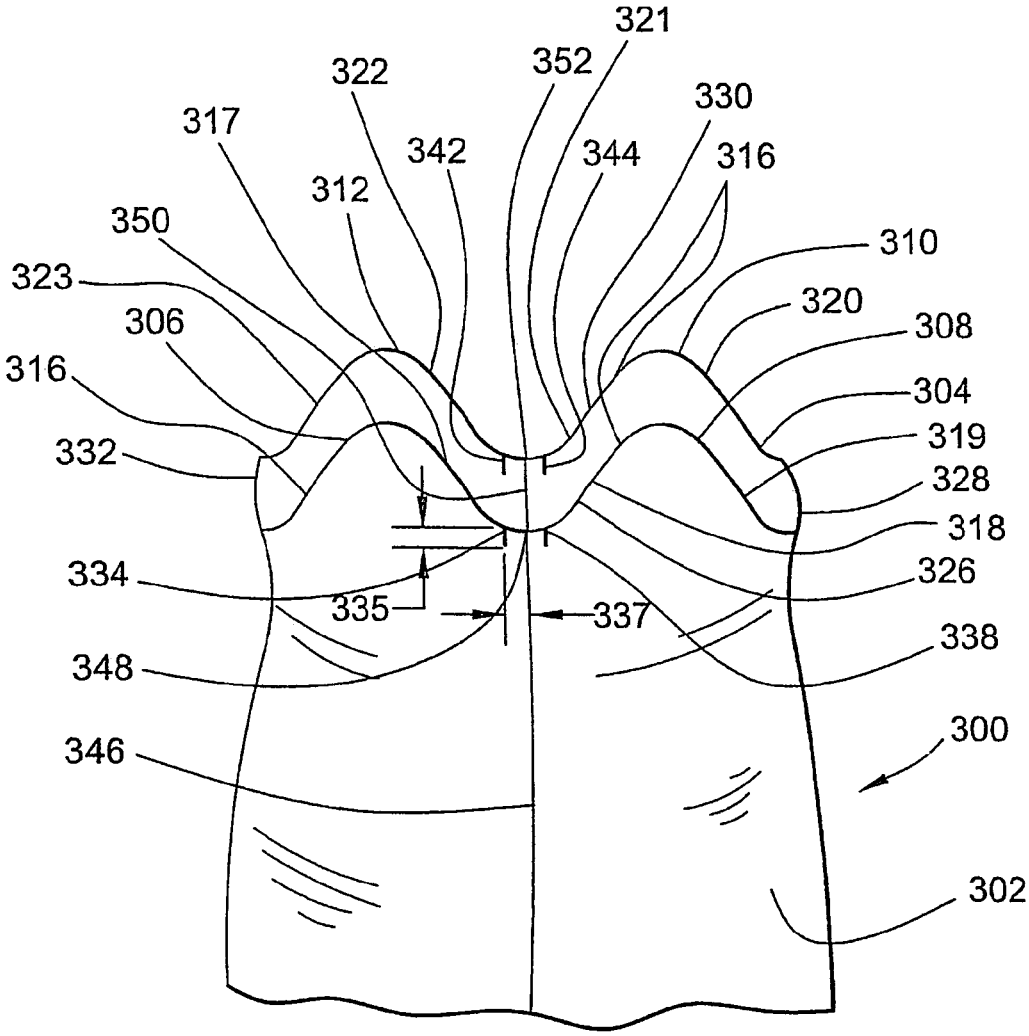
FIG. 6 is a perspective view of a tie bag with four flaps and four valleys, wherein the valley has two slits.
Figure 7:
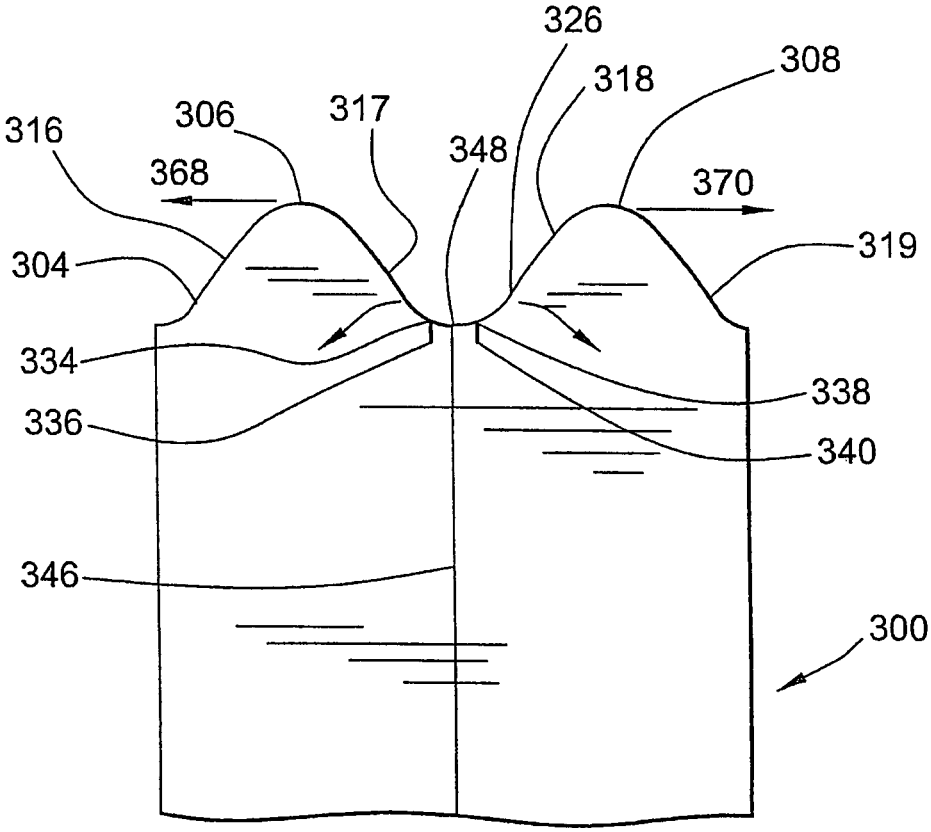
FIG. 7 is a side profile of the bag of FIG. 6 showing two flaps and a valley.

In another embodiment of the present invention, as shown in FIGS. 6 and 7, the tie bag 300 may include a bag body 302 and a top edge 304 defining an opening. The top edge 304 may include four flaps 306, 308, 310, 312 and four valleys 326, 328, 330, 332, wherein the flaps 306, 308, 310, 312 may be to tied together to at least partially close the bag 300. The top edge 304 may transition between the flaps 306, 308, 310, 312 and valleys 326, 328, 330, 332 along curves 316, 317, 318, 319, 320, 321, 322, 323. The bag 300 may also include a first seam 346 in the bag body 302 that intersects the top edge 304 at the point 348 of a first valley 326. The first valley 326 may include two slits 334, 338 in the top edge 304 that extend into the bag body 302. The slit 334 may be located on one side of the seam 346 and slit 338 may be located on the other side of the seam 346, as shown in FIG. 7. In this embodiment, the slits 334, 338 may extend from the top edge 304 parallel to the seam 346. In other embodiments, the slits may not be parallel to the seam 346. The tie bag 300 may also include a second seam 350 that intersects the point 352 of the third valley 330, as shown in FIG. 6. The third valley 330 may include third and fourth slits 342, 344 configured similarly to those of the first valley 326.

Referring to FIG. 6, in one embodiment, the length 335 of the slit 334 may be 0.125 to 4 inches (0.3125 to 10 cm). In another embodiment, the length 335 of slit 334 may be 0.125 to 1.5 inches (0.3125 to 3.75 cm). In another embodiment, the length 335 of the slit 334 may be 0.25 to 1 inches (0.625 to 2.5 cm). In another embodiment, the length 335 of the slit 334 may be 0.25 inches (0.625 cm). Referring to FIG. 6, in one embodiment, the distance 337 between the slit 334 and the seam 346 may be 0.125 to 12 inches (0.3125 to 30 cm). In another embodiment, the distance 337 between the slit 334 and the seam 346 may be 0.125 to 2 inches (0.3125 to 5 cm). In another embodiment, the distance 337 between the slit 334 and the seam 346 may be 0.125 to 1 inches (0.3125 to 2.5 cm). In another embodiment, the length may be 0.5 inches (1.25 cm).

Figure 8:
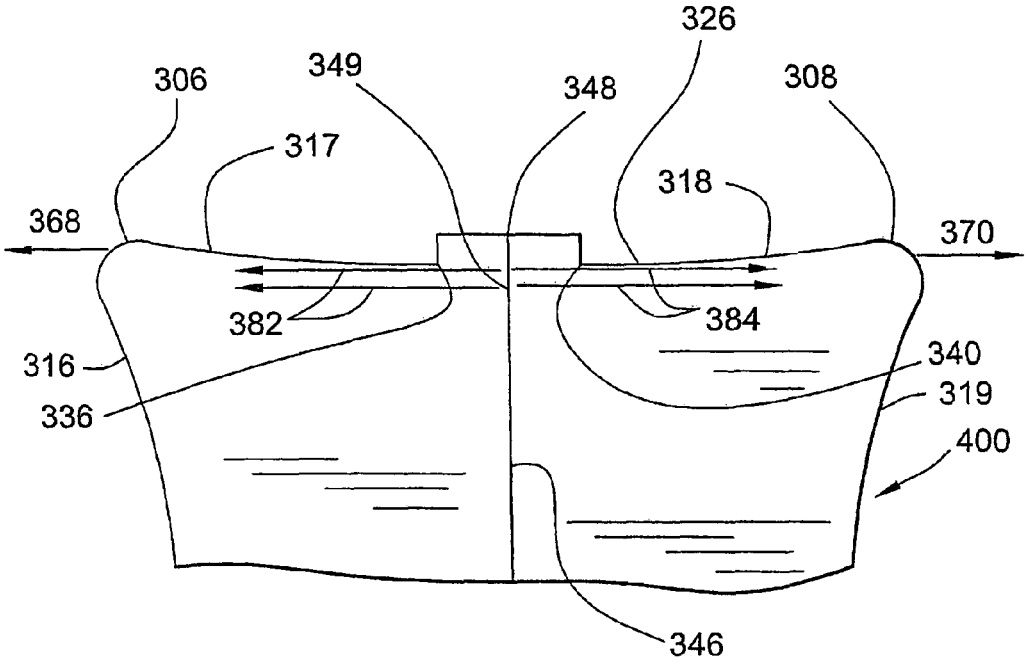
FIG. 8 is the same view as FIG. 7, but the flaps are subject to opposing forces.

Referring to FIG. 7, the first and second slits 334, 338 reduce the tension at the intersection point 348 of the first seam 346 with the top edge 304. As the first and second flaps 306, 308 are pulled apart, as shown by forces 368 and 370 in FIG. 7, the flaps 306, 308 tend to pivot out around the lowest point in the valley 326. As shown in FIG. 8, because the bottoms 336, 340 of the slits 334, 338 are below the intersection point 348 of the seam 346, the bottoms 336, 340 of the slits 334, 338 act as the pivot points for the flaps 306, 308. The forces 382, 384 pulling on the seam 346 accordingly shift down from the intersection point 348 to an area 349 generally level with the bottoms 336, 340 of the slits 334, 338. Thus, it is more difficult to initiate a tear in the seam 346. The third and fourth slits 342, 344 similarly reduce the tension at the intersection point 352 of the second seam 350 and thus reduce the possibility of the initiation of a tear.

Figure 9:
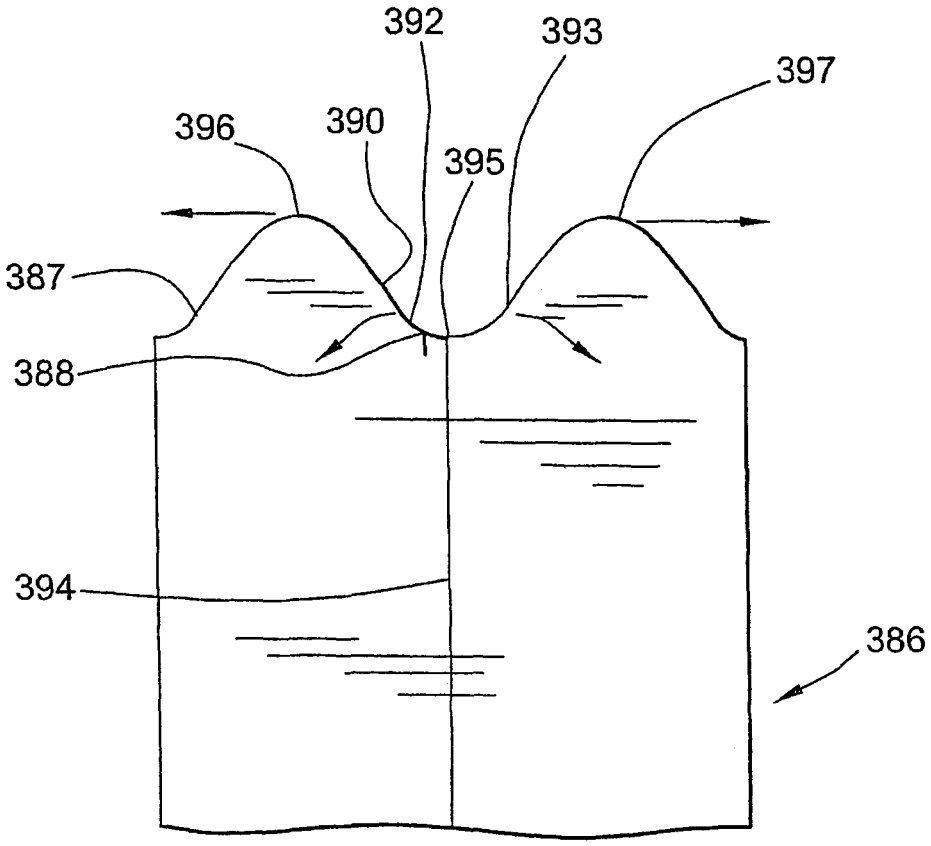
FIG. 9 is a side profile of a bag with only one slit.
Figure 10:
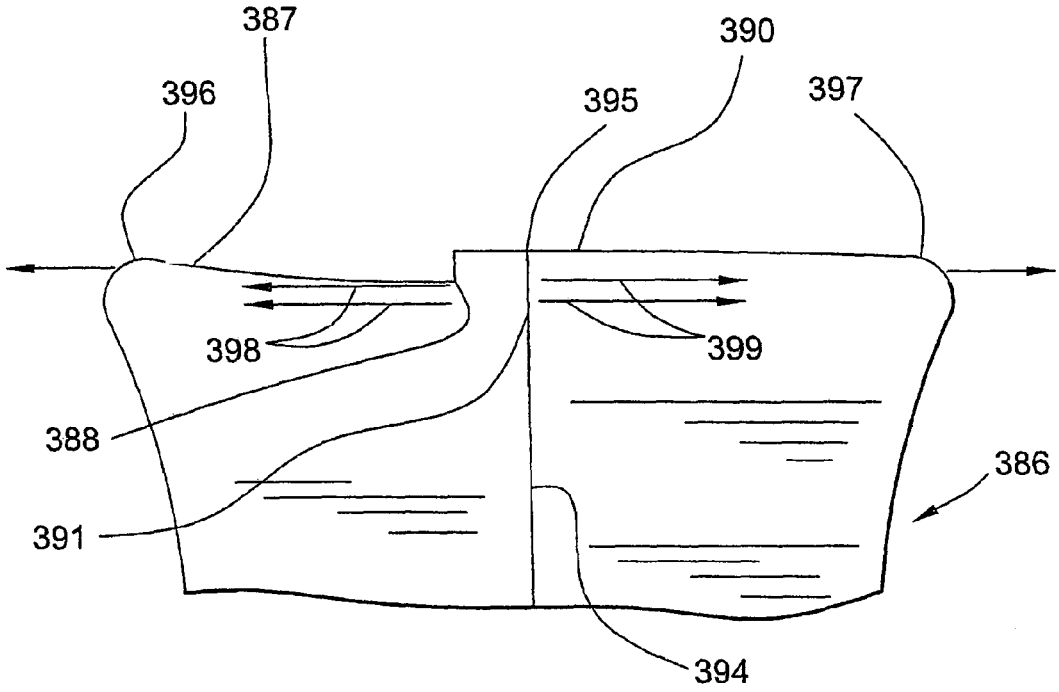
FIG. 10 is the same view as FIG. 9, but the flaps are subject to opposing forces.

In another embodiment, shown in FIGS. 9 and 10, the first valley 390 of the bag 386 may include only one slit 388. For example, the valley 390 may be divided into a first side 392 and a second side 393, and the slit 388 may be located on the first side 392, as shown in FIG. 9. Having a single slit 388 helps the bag 386 resist tears at the point 395 where the seam 394 meets the top edge 387. Referring to FIG. 10, as the flaps 396, 397 are pulled apart, the forces 398, 399 that act on the seam 394 are spread out between the point 395 where the seam 394 meets the top edge 387 and a lower point 391 on the seam 394. The tension at the intersection point 395 is thereby reduced and the initiation of a tear at the seam 394 is less likely. In another embodiment, the slit 388 may be located on the second side 393 of the valley 390. In another embodiment, the first valley 390 may include multiple slits on one side of the seam 394 or on both sides of the seam 394. In another embodiment, the slit 388 of the first valley 390 may represent the only slit along the entire top edge 387 of the bag.

Figure 11:
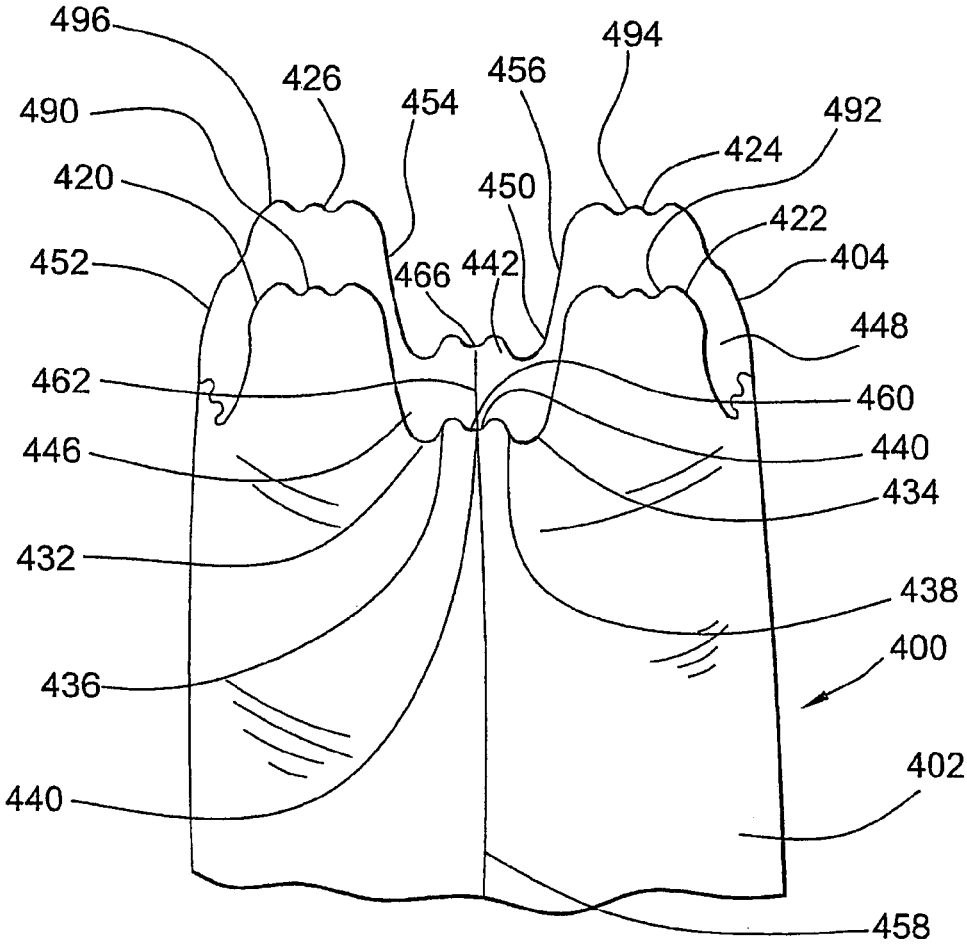
FIG. 11 is a perspective view of a tie bag with four flaps and four valleys, wherein the valleys have secondary peaks and a center valley.
Figure 12:
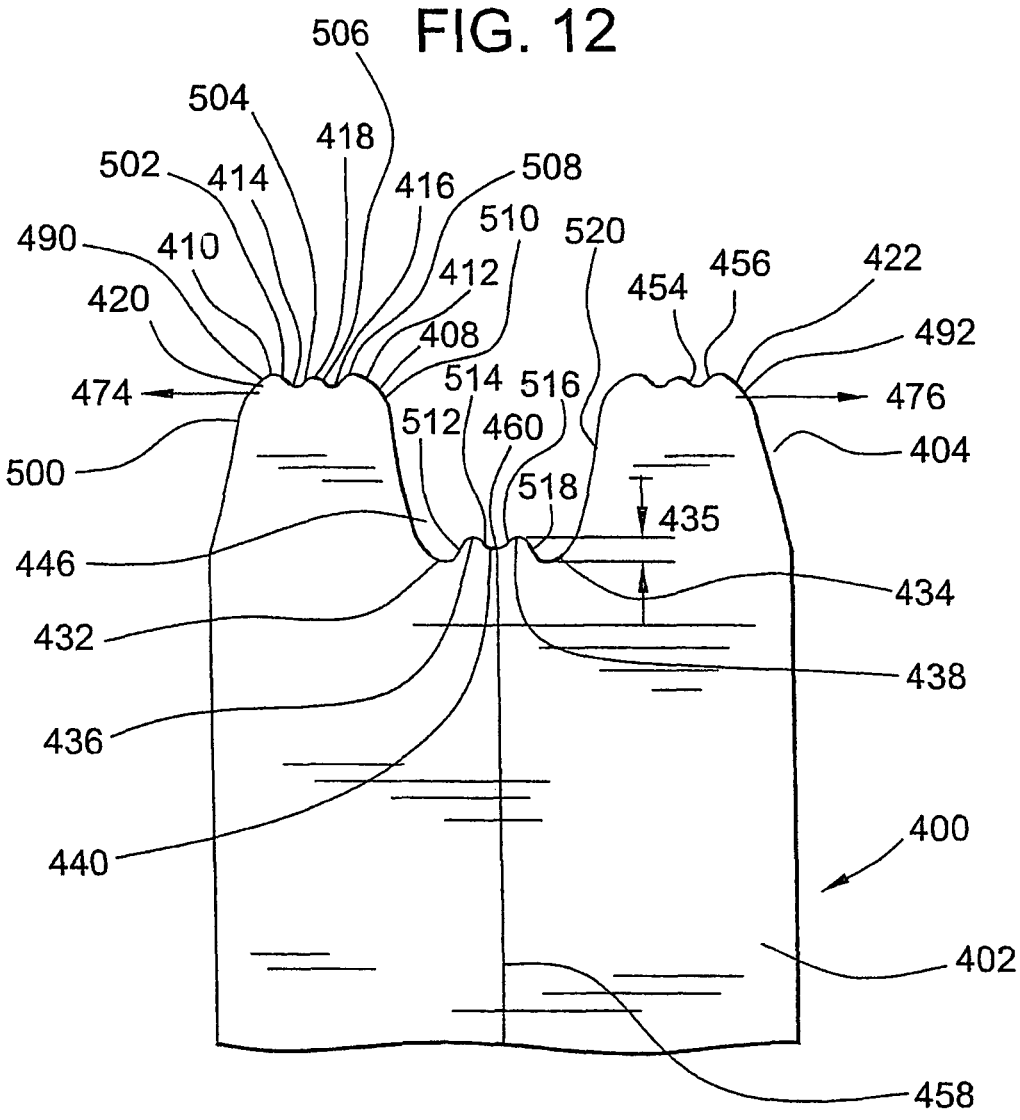
FIG. 12 is a side profile of the bag of FIG. 11 showing two flaps and a valley.

In another embodiment of the present invention, as shown in FIGS. 11 and 12, the tie bag 400 may include a bag body 402 and a top edge 404 defining an opening. The top edge 404 may include four flaps 420, 422, 424, 426 defining primary peaks 490, 492, 494, 496 and four primary valleys 446, 448, 450, 452. Valleys 446, 448, 450, 452 may be similar in shape. Thus, valley 446 will be described. Primary valley 446 includes two secondary valleys 432, 434 located outside of two secondary peaks 436, 438. A center valley 440 is located between the secondary peaks 436, 438. The center valley 440 may not be as deep as its surrounding secondary valleys 432, 434. The peaks 490, 492, 494, 496 may be similar in shape. Thus, peak 490 will be described. Referring to FIG. 12, the primary peak 490 may include two secondary peaks 410, 412 located outside of two secondary valleys 414, 416. There may be a center peak 418 disposed between the secondary valleys 414, 416. The peaks and valleys, both primary and secondary, may be connected along curves 500, 502, 504, 506, 508, 510, 512, 514, 516, 518, 520 that join them to the peaks or valleys proximate them along the top edge. The flaps 420, 422, 424, 426 may be to tied together to at least partially close the bag 400.

Referring to FIG. 12, in one embodiment, the distance 435 between the bottom of the secondary valley 434 and the top of the secondary peak 438 may be 0.125 to 4 inches (0.3125 to 10 cm). In a second embodiment, the distance 435 between the bottom of the secondary valley 434 and the top of the secondary peak 438 may be 0.25 to 2 inches (0.625 to 5 cm). In a third embodiment, the distance 435 between the bottom of the secondary valley 434 and the top of the secondary peak 438 may be 1 inch (2.5 cm).

The bag 400 may include a first seam 458 in the bag body 402 that intersects the top edge 404 at a point 460. Point 460 may be located at the bottom of the center valley 440 of the first valley 446. The bag 400 may also include a second seam 462 that intersects the top edge 404 at a point 466. The point 466 may be located at the bottom of the center valley 442 of the third valley 450.

Figure 13:
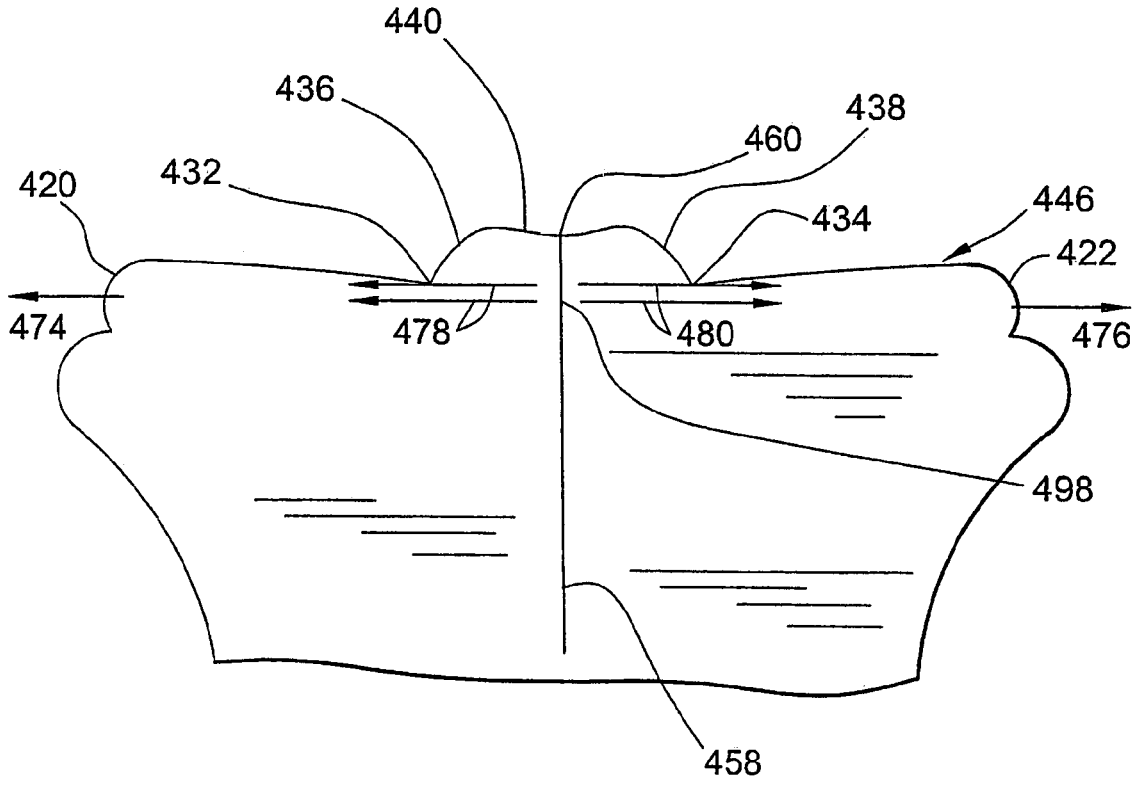
FIG. 13 is the same view as FIG. 12, but the flaps are subject to opposing forces.

Referring to FIG. 12, in this embodiment, the intersection point 460 of the seam 458 is not in the lowest point of the primary valley 446, as the secondary valleys 432, 434 are deeper than the center valley 440. Accordingly, as the first and second flaps 420, 422 are pulled apart, as shown by force arrows 474 and 476 in FIG. 12, the bottoms of the secondary valleys 432, 434 may act as the pivot points for the flaps 420, 422. As shown in FIG. 13, as the flaps 420, 422 are pulled apart, the secondary peaks 436, 438 and the center valley 440 will remain slightly raised such that the intersection point 460 of the seam 458 remains above the bottoms of the secondary valleys 432, 434. Accordingly, the forces 478, 480 will be applied generally level with the bottom of the secondary valleys 432, 434 at point 498 on the seam 458. The seam 458 is more resistant to tearing at point 498. It is therefore less likely a tear will be initiated at the intersection point 460 of the seam 458.

Figure 14:
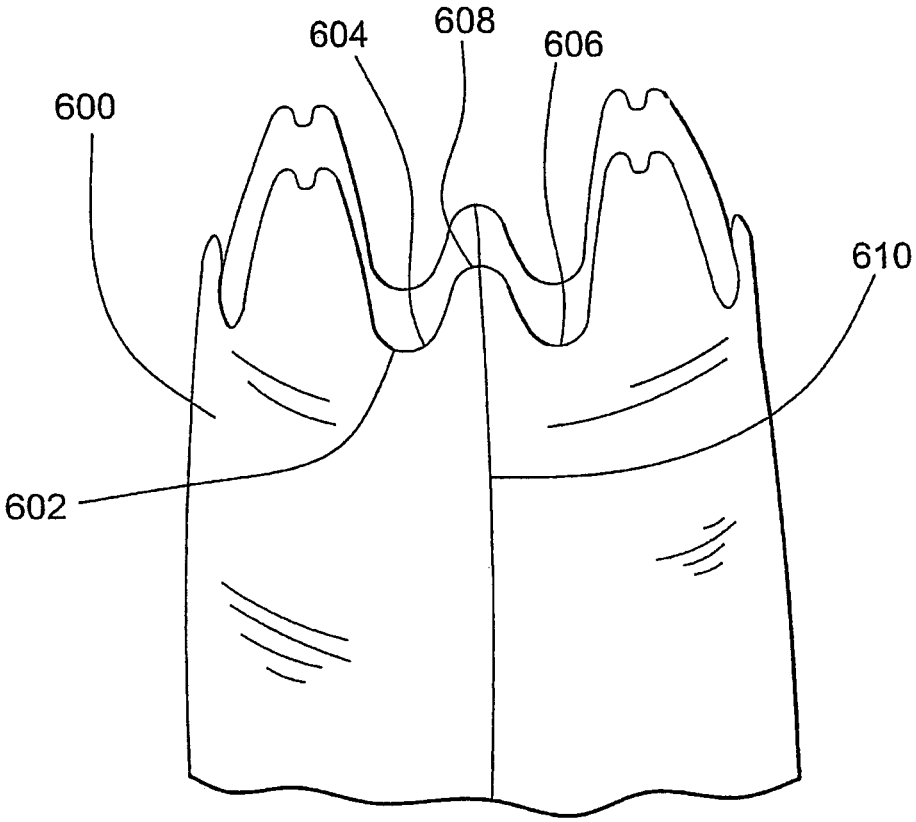
FIG. 14 is a perspective view of a tie bag with four flaps and four valleys, wherein the valleys have secondary valleys and a center peak.

In another embodiment, as shown in FIG. 14, the bag 600 may be similar to the embodiment in FIG. 11, but the bag 600 may include no center valleys. The primary valley 602 includes a center peak 608 disposed between two secondary valleys 604, 606. The center peak 608 has a rounded apex and the seam 610 may intersect the valley 602 at the center peak 608. This embodiment may display similar behavior and resistance against tearing of the seam 610 under strain as the embodiment depicted in FIGS. 11-13. This embodiment may also be similarly dimensioned as the embodiment depicted in FIGS. 11-13 with respect to the distance between the bottom of the secondary valley and the top of the center peak.

Figure 15:
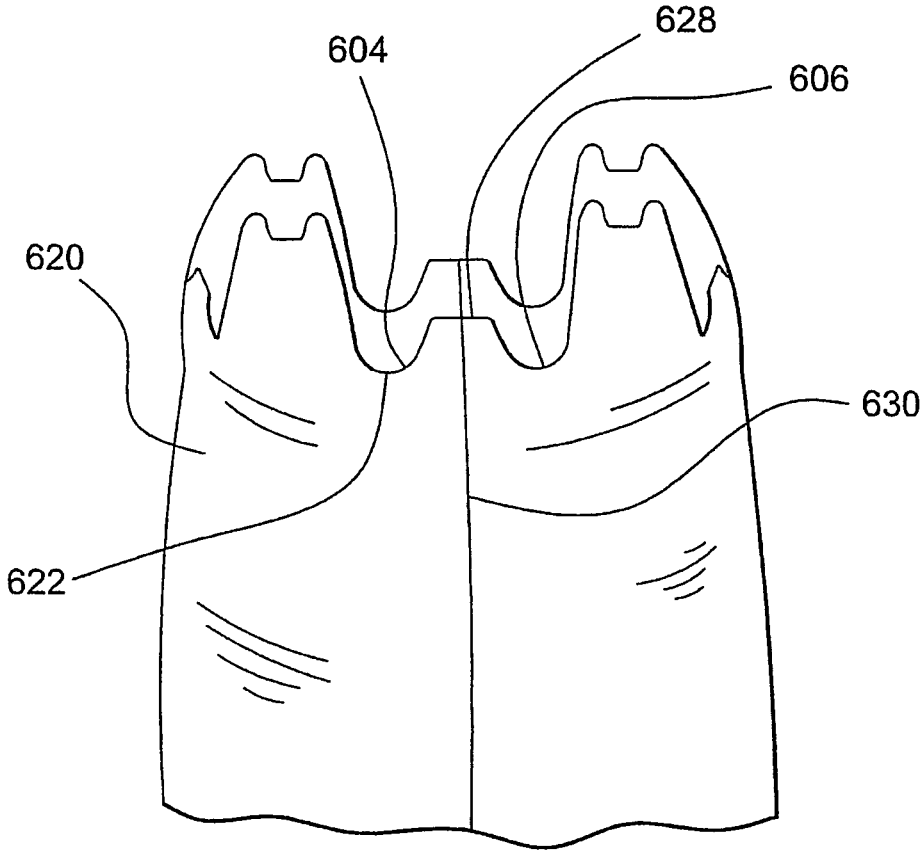
FIG. 15 is perspective view of a tie bag with four flaps and a four valleys, wherein the valleys have secondary valleys and center peaks that are flat on top.

In another embodiment, as shown in FIG. 15, the bag 620 may be similar to the embodiment in FIG. 14, but the center peak 628 is flat on top. The primary valley 622 of the bag 620 includes a center peak 628 disposed between two secondary valleys 624, 626. The seam 630 may intersect the primary valley 622 at the center peak 628. This embodiment may display similar behavior and resistance against tearing of the seam 630 under strain as the embodiment depicted in FIGS. 11-13. This embodiment may also be similarly dimensioned as the embodiment depicted in FIGS. 11-13 with respect to the distance between the bottom of the secondary valley and the top of the center peak.

Figure 16:
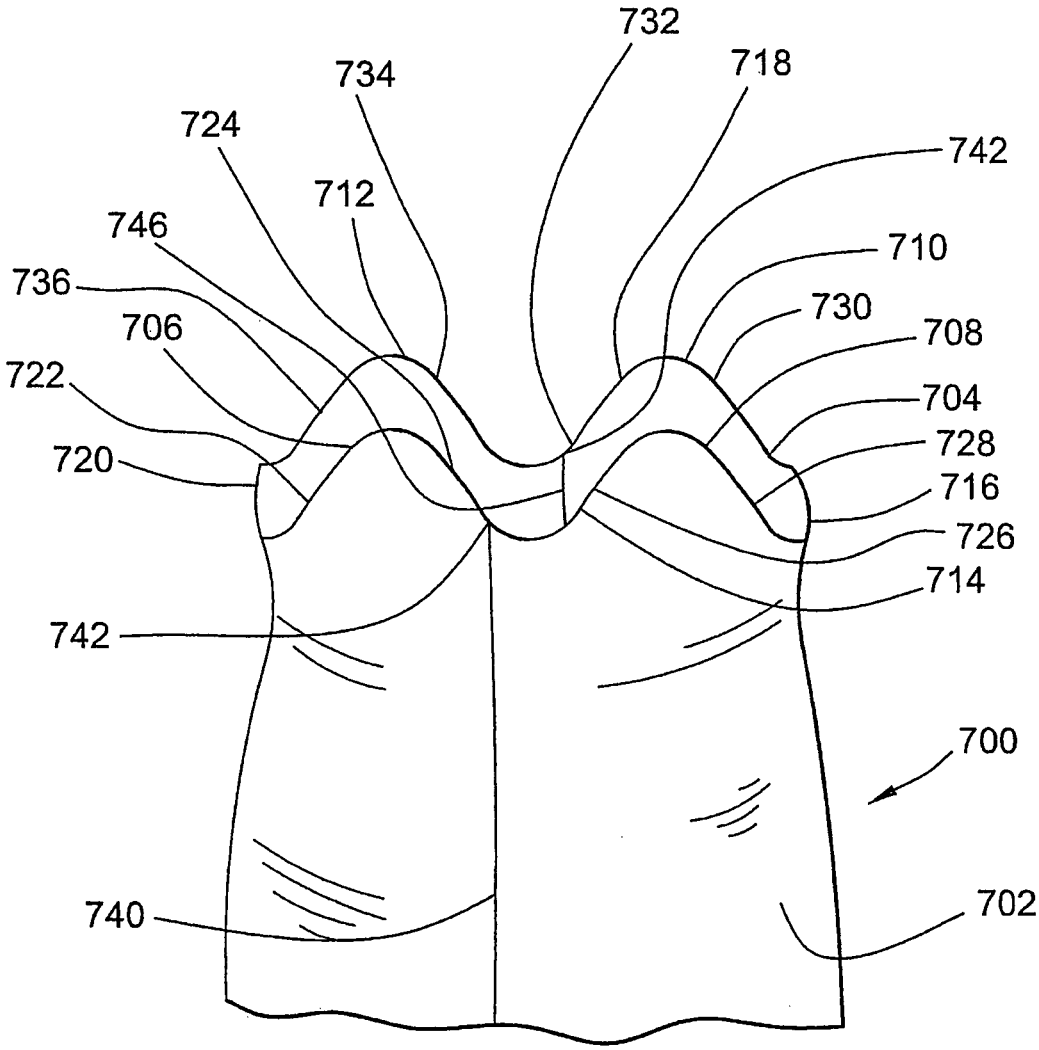
FIG. 16 is a perspective view of a tie bag with four flaps and four valleys, wherein the seams do not intersect the valleys at the lowest points of the valleys.
Figure 17:
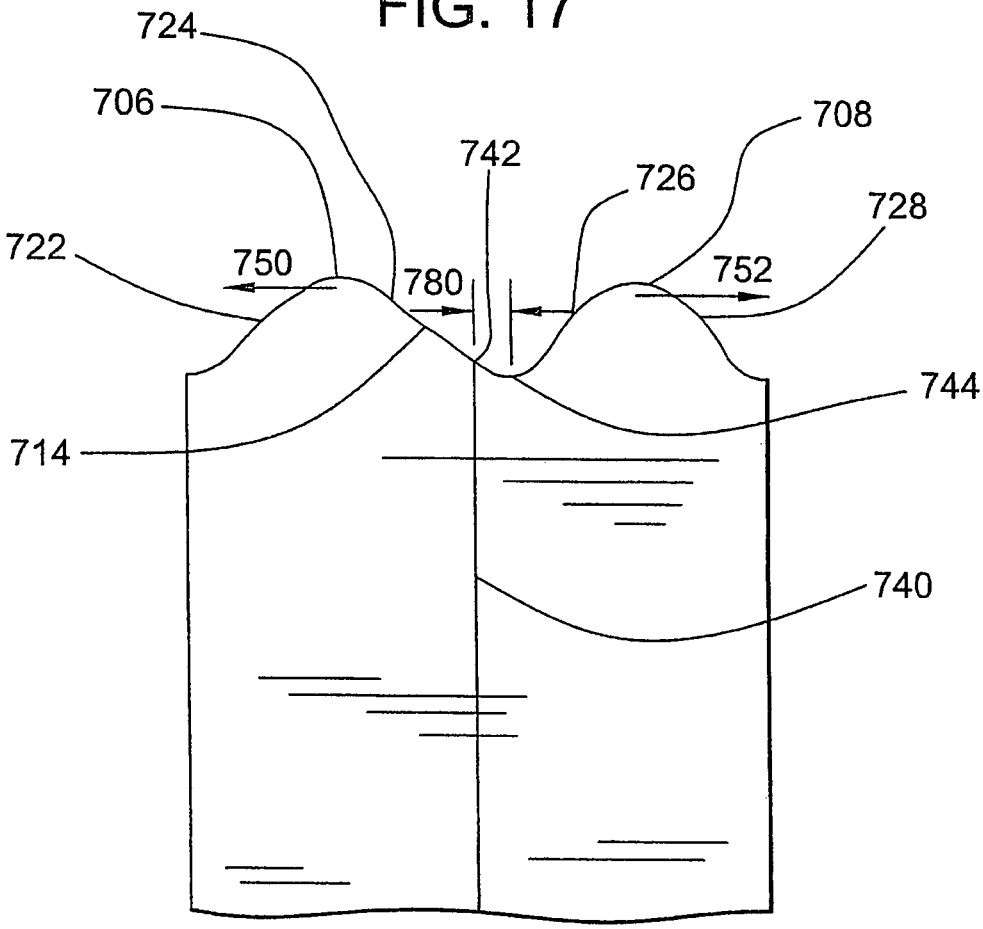
FIG. 17 is a side profile of the bag of FIG. 16 showing two flaps and a valley.
Figure 18:
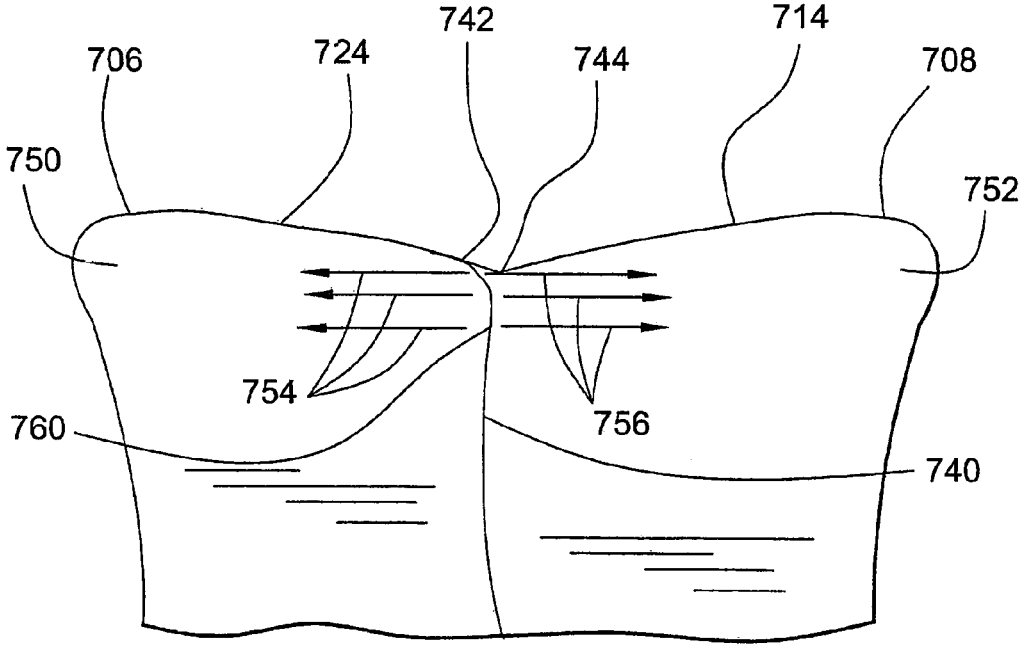
FIG. 18 is the same view as FIG. 17, but the flaps are subject to opposing forces.

In another embodiment of the present invention, as shown in FIGS. 16-18, the bag 700 includes a bag body 702 and a top edge 704 defining an opening. The top edge 704 may include four flaps 706, 708, 710, 712 and four valleys 714, 716, 718, 720, wherein the flaps 706, 708, 710, 712 may be tied together to at least partially close the bag 700. The top edge 704 may transition between the flaps 706, 708, 710, 712 and valleys 714, 716, 718, 720 along curves 722, 724, 726, 728, 730, 732, 734, 736. The bag may also include a first seam 740 in the bag body 702 that intersects the top edge 704 at the point 742 of the first valley 714. Referring to FIG. 17, the intersection point 742 of the seam 740 is not located at the lowest point 744 of the first valley 714. Accordingly, the intersection point 742 is located part way up curve 724. In another embodiment, the intersection point 742 may be located along curve 726. Referring to FIG. 16, The bag 700 may also include a second seam 746 that intersects the third valley 718 at a point 748 part way up curve 732, such that the intersection point 742 is not located at the lowest point of the valley 718.

Referring to FIG. 17, in one embodiment, the offset 780 between the lowest point 744 and the seam 740 may be 0.125 to 12 inches (0.3125 to 30 cm). In a second embodiment, the offset 780 between the lowest point 744 and the seam 740 may be 0.5 to 2 inches (1.25 to 5 cm). In a third embodiment, the offset 780 between the lowest point 744 and the seam 740 may be 1 to 2 inches (2.5 to 5 cm). In a fourth embodiment, the offset 780 between the lowest point 744 and the seam 740 may be 1.5 inches (3.75 cm).

Referring to FIG. 18, as the first and second flaps 706, 708 are pulled apart by forces 750 and 752, the flaps 706, 708 tend to pivot out around the lowest point 744 in the first valley 714. Accordingly, forces 750, 752 subject the lowest point 744 of the valley 714 to the greatest tension. The forces 754, 756, that subject the seam 740 to tension and which are substantially perpendicular to the seam are therefore spread out between the lowest point 744 and a point 760 below the lowest point 744. The possibility that a tear will initiate at the intersection point 742 of the seam 740 and the top edge 704 is thereby reduced.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A tie bag comprising:

a bag body;

a top edge defining an opening, wherein the top edge includes at least two flaps, a first valley, and a second valley, wherein the flaps may be to tied together to at least partially close the bag, wherein the top edge transitions between the flaps and valleys along curves;

at least one first seam formed by heat sealing in the bag body that intersects the top edge at the first valley, wherein the seam divides the first valley into a first side and a second side; and wherein the first valley includes a slit in the top edge that extends into the bag body parallel to the seam, wherein the slit is located on the first side of the first valley.

2. The tie hag of claim 1, wherein the hag includes four flaps and four valleys.

3. The tie bag of claim 1, further comprising a second seam that intersects the top edge at the second valley, wherein the bag also includes a second slit in the top edge that extends into the bag body parallel to the second seam, the second slit is located on a first side of the second seam in the second valley.

4. The tie hag of claim 3, wherein the first valley includes a third slit parallel to the first seam and the second valley includes a fourth slit parallel to the second seam.

5. The tie bag of claim 1, wherein the shape of the top edge is defined by part of a sinusoidal curve.

6. A tie bag comprising;

a bag body;

a top edge defining an opening, wherein the top edge includes, at least two flaps defining primary peaks, at least two primary valleys, a first primary valley and a second primary valley, wherein each primary valley includes two center peaks disposed between two secondary valleys, wherein at least one seam in the bag body intersects the top edge between the center peaks of the first primary valley, wherein the primary valleys are larger than the secondary valleys and the primary peaks are larger than the center peaks, and wherein the flaps may be to tied together to at least partially the bag.

7. The tie bag of claim 6, further comprising a second seam in the bag body that intersects the top edge at a center peak of the second valley.

* * * * *